United States Patent [19]

Jandeska, Jr. et al.

[11] Patent Number: 4,886,637

[45] Date of Patent: Dec. 12, 1989

[54] PRESINTER TREATMENT FOR IRON POWDER ARTICLE FORMED WITH BORIDE ADDITIVE

[75] Inventors: William F. Jandeska, Jr., Rochester; Vadim Rezhets, West Bloomfield; Carlo Ligotti, Romeo, all of Mich.

[73] Assignee: General Motors Corporation, Detroit, Mich.

[21] Appl. No.: 342,764

[22] Filed: Apr. 17, 1989

[51] Int. Cl.[4] ..... B22F 1/00

[52] U.S. Cl. ..... 419/12; 419/42; 419/45; 419/47; 419/53; 419/56; 75/242; 75/244

[58] Field of Search ..... 419/12, 42, 45, 47, 419/53, 56; 75/242, 244

[56] References Cited

U.S. PATENT DOCUMENTS 3,937,630 2/1976 Kimura et al. ..... 75/200
4,618,473 10/1980 Jandeska, Jr. ..... 419/11
4,678,510 7/1987 Jandeska, Jr. et al. ..... 75/244
4,704,251 11/1987 Kremer ..... 419/17

*Primary Examiner*—Stephen J. Lechert, Jr.
*Assistant Examiner*—Ngoclan Mai
*Attorney, Agent, or Firm*—Douglas D. Fekete

[57] ABSTRACT

A presinter treatment is provided to reduce oxygen contamination prior to sintering a predominantly iron powder compact comprising carbon powder and a liquating diffusible boron source, such as nickel boride powder optionally in combination with iron boride powder. A preferred treatment is carried out at a temperature effective to dissociate iron oxide within the compact but not to initiate a liquid phase by said boron source and further is carried out in a vacuum to evacuate oxygen released thereby from compact pores prior to sintering. The presinter treatment enhances carbon and boron diffusion into the iron during sintering. In a preferred embodiment, the fraction of borocementite particles formed by diffused carbon and boron in the sintered iron structure is increased by the presinter treatment of this invention.

4 Claims, No Drawings

PRESINTER TREATMENT FOR IRON POWDER ARTICLE FORMED WITH BORIDE ADDITIVE

BACKGROUND OF THE INVENTION

This invention relates to a wear resistant iron alloy article formed by compacting a predominantly iron powder mixture containing carbon powder and a boron source and sintering under conditions that cause the carbon and boron to diffuse into the iron to form dispersed, hard borocementite particles. More particularly, this invention relates to a presinter treatment to expel contaminant oxygen from the compact to enhance carbon and boron diffusion and to thereby increase borocementite formation.

U.S. Pat. No. 4,678,510, issued to Jandeska et al in 1987, describes an iron alloy article characterized by hard borocementite particles dispersed in an iron alloy matrix to enhance wear resistance. The article is produced by compacting and sintering a powder mixture composed predominantly of low-carbon iron powder and including carbon powder and a liquating diffusible boron source. A preferred boron source comprises a combination of nickel boride powder and iron boride powder. An expendable lubricant is included to facilitate compaction and is vaporized at a relatively low temperature, typically not greater than about 500° C., during the early stages of the sintering cycle. Sintering is typically carried out at a temperature between about 1100° C. and 1120° C. to bond the iron into an integral structure. During sintering, carbon diffuses into the structure to form a mainly pearlitic or martensitic matrix. The boron additive forms, within the environment of the compact during sintering, a transient liquid phase, whereafter boron diffuses into the iron and combines with carbon to produce the desired borocementite particles.

Although the borocementite particles form a hard phase that substantially improves wear resistance, it is desired to minimize the boride additions no only to minimize the cost associated therewith, but also because the brittle boride reduces compressibility of the powder mixture. This increases the compaction force required to produce a green compact having adequate strength for handling and accelerates die wear.

Sintering is preferably carried out in a vacuum to avoid oxidation of constituents, including in particular the boron, since boron oxide does not suitably relinquish boron for diffusion. It is also found that boron oxidation interferes with carbon diffusion, particularly noticeable within interior regions of large compacts, resulting in the presence of carbon-deficient, relatively soft ferrite grains that reduce mechanical properties of the product. U.S. Ser. No. 161,518, filed by Jandeska et al on Feb. 29, 1988, describes an addition of an agent comprising an oxygen getter, preferably iron titanium alloy powder, to promote carbon and boron diffusion and thereby produce a more uniform product microstructure. While the addition of an oxygen getter satisfactorily inhibits boron oxidation, the addition increases cost and further reduces compressibility. Thus, it is desired to minimize, or even possibly eliminate, the oxygen getter addition without compromising carbon and boron diffusion.

It has now been found that a major source of oxygen within the compact during sintering is iron oxide that contaminates surfaces of iron particles. As the evacuated compact is heated to sintering temperature, the iron oxide dissociates, releasing oxygen for reaction with boron. In addition, exposure of boron to the oxygen, and thus the susceptibility to oxidation, is increased by the formation of the liquid phase during sintering.

It is an object of this invention to provide an improved method for manufacturing an iron alloy article by compacting and sintering a predominantly iron mixture comprising carbon and boron additions, which method comprises a presinter treatment to reduce oxygen contamination within the compact and thereby enhance carbon and boron diffusion during sintering.

It is a more particular object of this invention to provide a presinter treatment carried out prior to sintering a predominantly iron powder compact comprising carbon powder and a liquating diffusible boron source to form an iron alloy product characterized by dispersed, hard borocementite particles that enhance wear resistance, which presinter treatment is effective to decompose iron oxide contaminant within the compact and expel the unwanted oxygen released thereby prior to activating the boron source and thus promotes more efficient carbon and boron diffusion during sintering as evidenced by increased borocementite formation and a more uniform matrix microstructure. As a result, the amount of boron source in the powder mixture may be reduced, improving compressibility, extending die life and ultimately reducing raw material and processing costs. In one aspect of this invention, the presinter treatment permits the amount of oxygen getter additive to be reduced, or even possibly eliminated, further improving compressibility and reducing cost.

SUMMARY OF THE INVENTION

In accordance with a preferred embodiment of this invention, these and other objects are accomplished by a presinter treatment carried out prior to sintering an iron powder compact containing diffusible carbon and boron additions that to dissociate iron oxide within the compact and to evacuate oxygen released thereby. The compact is composed predominantly of low-carbon iron powder and initially includes carbon powder and a vaporizable lubricant. The compact further includes a liquating diffusible boron source formulated to form a liquid phase when heated to iron sintering temperature. A combination of nickel boride powder and iron boride powder is preferred for forming dispersed borocementite particles. Preferably, the compact may include copper powder to compensate for shrinkage during sintering and to enhance product strength. Also, the compact may include an additive including an oxygen getter to scavenger any residual oxygen released during sintering despite the presinter treatment.

The presinter treatment of this invention is carried out following lubricant vaporization but prior to heating to sintering temperature. Thus, the compact is initially heated at a first temperature, typically not greater than 500° C., for a time sufficient to purge lubricant vapors. In accordance with this invention, the compact is then subjected to an oxygen-purge presinter treatment by heating in a vacuum at a temperature effective to decompose iron oxide contaminant without initiating liquification by the boron additive, suitably between about 750° C. and 1030° C. A preferred temperature range is between about 850° C. and 900° C. to maximize heat transfer within the compact, particularly to interior regions, while minimizing consolidation that would otherwise close interconnected porosity necessary for satisfactory oxygen exhaustion. A portion of the released oxygen may react with the carbon to form carbon monoxide. Although some oxygen may react with boron, such reaction is restricted to boron at the surface of the solid powder, since the presinter is carried out prior to activating the boron-containing liquid phase. Furthermore, boron oxide has a significant vapor pressure at such elevated temperature, whereupon the boron oxide vapors may be exhausted prior to sintering. The pretreatment is continued for a time sufficient to evacuate oxygen-bearing gas from the pores, preferably between about 15 and 45 minutes.

Following the presinter treatment, the compact is further heated at an elevated temperature, typically above about 1100° C., to bond the iron into an integral structure and to diffuse carbon and boron into the iron to form a microstructure comprising hard borocementite particles dispersed in a martensitic or pearlitic matrix. By removing oxygen contaminant from the compact prior to activating the boron additive, the presinter treatment allows more efficient diffusion of the carbon and boron to promote adequate carburization to assure a substantially ferrite-free matrix and to maximize borocementite formation. As a result, the amounts of carbon and boron source additions for a desired borocementite fraction may be optimized. Furthermore, the addition of an oxygen getter may be reduced or possibly eliminated. By reducing the additives, this invention facilitates compaction of the powder mixture and lessens die wear, ultimately lowering the cost associated with manufacturing the wear-resistant product article, while assuring the desired product microstructure.

DETAILED DESCRIPTION OF THE INVENTION

In a preferred embodiment of this invention, a predominantly iron powder mixture was sintered using a heating cycle that included an isothermal presinter treatment to produce a wear resistant iron article comprising borocementite particles distributed in an iron alloy matrix. The powder mixture was composed of, by weight, about 2.0 parts copper powder, 3.5 parts iron boride powder, 0.9 parts nickel boride powder, 1.4 parts ferro-titanium powder, 1.4 parts graphite powder, 0.4 parts lubricant and 90.4 parts prealloyed iron powder. The iron powder was composed of a low-carbon alloy containing about 0.26 weight percent manganese, about 0.45 weight percent nickel, about 0.6 weight percent molybdenum, about 0.02 weight percent carbon and the balance iron and impurities and is commercially available from the Hoeganaes Corporation under the trade designation Ancorsteel A2000. The iron powder was sized to −60 mesh. The graphite powder was a commercial grade material having particle size between 2 and 5 microns. The metallic copper powder was a commercial purity material sized to −325 mesh. The nickel boride powder an arc-melted material composed substantially of intermetallic compound NiB and contained 16 weight percent boron, the balance nickel and impurities. The iron boride powder consisted substantially of intermetallic compound FeB and contained 18 weight percent boron, the balance iron and impurities. To obtain the powder, commercially available nickel boride and iron boride were fragmented and sized to −400 mesh. The ferro-titanium powder was composed mainly of FeTi2 and contained about 70 weight percent titanium, which acted as an oxygen getter during sintering to further inhibit boron oxidation. The die lubricant was a co-atomized wax-base material containing about 0.8 percent zinc stearate.

The several powders were blended to form a homogeneous mixture. During blending, a minor amount of a vaporizable organic material was added to reduce dusting, minimize carbon segregation and enhance powder flow. The mixture was loaded into a suitable die and compacted to produce a green compact having a generally annular shape. The green compact had a density of about 6.9 grams per cubic centimeter, corresponding to about 93 percent of theoretical density. The green compact was loaded into a vacuum furnace and sintered using a three-step heating cycle. The furnace was initially evacuated to a pressure less than $10^{-3}$ torr and heated to about 500° C. to vaporize the lubricant and organic additive. The compact was held at this temperature for about 15 minutes, during which dry nitrogen gas was introduced into the furnace to a pressure of about 600 torr and the furnace again evacuated to $10^{-3}$ torr. This nitrogen backfill provides a convective media for more efficient heating and assists in sweeping lubricant vapors from the compact.

Following lubricant vaporization, the compact was subjected to a presintered treatment in accordance with this invention. The temperature of the compact was raised to 850° C. and maintained for about 15 minutes, while continuing a vacuum pressure at about $10^{-3}$ torr.

Following the presinter treatment, the compact was heated to 1120° C. for about 20 minutes for sintering. Thereafter, the compact was gas quenched by introducing cool dry nitrogen gas to a pressure of about 600 torr.

The product sintered article exhibited a microstructure comprising borocementite particles distributed within a matrix composed mainly of pearlite and martensite. Minor amounts of retained austenite were observed adjacent pores and are attributed to limited nickel diffusion into the iron resulting in a localized nickel concentration sufficient to stabilize austenite to room temperature. Of more significance to this invention, the borocementite fraction was estimated to be about 36 percent by volume. For purposes of comparison, a green compact formed of an identical composition was sintered by a similar process but without the presinter treatment at 850° C. That is, the compact was heated first to 500° C. for 15 minutes, during which it was subjected to a nitrogen backfill, and thereafter heated directly to 1120° C. for 20 minutes, followed by a nitrogen gas quench. The sintered product exhibited a substantially similar microstructure, but the volume fraction of borocementite particles was approximately 31.1 percent. Thus, the presinter treatment of this invention increased the borocementite volume fraction by 4.9 percent, which directly improved the wear resistance of the product.

Also, for comparative purposes, a sintered product having 36 volume percent borocementite fraction was produced by a similar heating cycle, but without the presinter treatment of this invention, from a similar powder mixture that included about 4.2 weight percent iron boride powder, about 1.0 weight percent nickel boride powder and about 2.0 weight percent ferrotitanium powder. Thus, the presinter treatment of this invention reduces the amounts of boride additives and oxygen getter additive required to produce a desired borocementite fraction. This not only reduces raw material and processing costs, but also improves compressibility of the powder mixture, thereby decreasing the compaction force required to form a green compact having adequate strength for handling and also alleviating wear on tooling.

While not limited to any particular theory, it is believed that, in the absence of a presinter treatment in accordance with this invention, iron oxide that contaminates the surfaces of commercially available iron powders decomposes during sintering and releases oxygen which oxidizes boron to form boron oxide that is stable at iron sintering temperatures. Thus, once formed, the boron oxide does not release boron for diffusion into the iron, so that the oxidized boron cannot participate in the formation of the desired borocementite particles. Furthermore, boron oxide that condenses upon surfaces of carbon particles is believed to poison the surfaces and interfere with carbon diffusion, thereby reducing the available carbon for borocementite formation and matrix alloying. In accordance with this invention, the compact is heated at a temperature sufficient to decompose the iron oxide contaminant, but without liquating the boride additives. A portion of the released oxygen may react with the additives, mainly to form carbon monoxide that is readily exhausted. Any boron oxidation is limited mainly to the surface of the solid boride particles, with the resultant oxide being to a large extent expelled prior to sintering. Thus, the oxygen is expelled into the ambient vacuum through the compact pores, either unreacted or in the form of carbon monoxide or a minimal amount of boron oxide. Thereafter, when the compact is heated for sintering, boron oxidation is minimized to promote diffusion of both boron and carbon into the iron and thereby increase borocementite formation.

In the described embodiment, the presinter treatment of this invention was carried out following vaporization of die lubricant added to the powder mixture to facilitate compaction. Lubricant vaporization is typically carried out at temperatures not greater than 500° C. to minimize decomposition that would otherwise produce unwanted deposits within the compact. Following lubricant removal, the compact was heated to a higher temperature effective to dissociate iron oxide. Suitable iron dissociation temperatures are 750° C. or higher. Higher temperatures are generally desired to accelerate interior heating. However, temperatures above about 1030° C. initiate liquid phase formation by the boride additives, thereby increasing boron activity and exposure for oxidation, and are thus not desired for the presinter treatment. Also, at temperatures above about 900° C., austenite phase transformation accelerates iron consolidation. This is believed to decrease open porosity, particularly by closing pores in exterior regions, further retarding oxygen evacuation from the interior. Thus, the presinter treatment is suitably carried out at between about 750° C. and 1030° C., with the range of between about 850° C. and 900° C. being preferred. The duration of the presinter treatment depends upon the time required to heat the compact interior to operative temperature and to evacuate oxygen therefrom, and is thus principally related to compact size. Treatment for at least about five minutes significantly reduces oxygen contamination within the compact interior. Longer times are desired to maximize oxygen expulsion and thereby minimize contamination during sintering. In general, treatments for between about 15 minutes and 45 minutes within the preferred temperature range are found to be effective without unjustifiably extending the processing time. While in the described embodiment the compact was heated isothermally, this invention may be suitably carried out while progressively heating the compact, provided that adequate time is provided within the presinter temperature range to permit adequate interior heating and oxygen evacuation.

While in the described embodiment the presinter treatment of this invention was employed to improve sintering of a mixture formulated to produce borocementite particles as described in U.S. Pat. No. 4,678,510, incorporated herein by reference, it may suitably be applied for sintering other powder mixtures composed mainly of low-carbon iron powder and containing (1), carbon powder and (2) a liquating additive containing oxidizable boron. Thus, this invention may be suitably applied in sintering a predominantly iron powder mixture that contains, in addition to carbon powder, nickel boride powder in amounts effective to form retained austenite in regions about pores in the U.S. Pat. No. 4,618,473, issued to Jandeska in 1986, incorporated herein by reference. In this embodiment, the retained austenite is attributed to nickel diffusion, rather than to the diffused boron. Although the presinter treatment may not be required to maximize the diffused boron, it may nevertheless be advantageous to promote the desired carbon diffusion and thereby avoid unwanted carbon-deficient ferrite grains.

With regard to sintering mixtures formulated to produce borocementite particles as in the described embodiment, a preferred mixture is composed predominantly of low-carbon iron powder and comprises between about 1 and 2 weight percent carbon powder, between about 0.8 and 3.1 weight percent nickel boride powder and iron boride powder in an amount sufficient to increase the total boron concentration to between 0.15 and 1.2 weight percent. The iron powder may be either unalloyed iron or low-carbon prealloyed iron. In addition to providing carbon in amounts sufficient to produce a hypereutectoid matrix and to combine with the boron to form borocementite particles, a slight excess of carbon powder, on the order of 0.03 weight percent, is provided to compensate for loss during vacuum sintering. Cobalt boride and manganese boride may be suitably substituted for the preferred nickel boride. Also, the powder mixture preferably comprises a copper addition of between about 2 and 3 weight percent for precipitation hardening and to compensate for iron shrinkage during sintering.

Although the method of this invention substantially reduces oxygen contamination within the compact during sintering that would otherwise inhibit boron and carbon diffusion, it is also preferred to include an additive that comprises an oxygen getter agent to scavenge any trace oxygen residual at sintering temperature and thereby further inhibit boron oxidation. Suitable oxygen getter agents are described in U.S. Serial No. 161,518, incorporated herein by reference, and preferably include titanium, vanadium, magnesium or rare earth elements that are preferentially oxygenreactive relative to boron, in combination with a suitable melting point depressant constituent, such as iron in the preferred iron titanium powder.

In the described embodiment, the green compact was treated within a vacuum furnace. While vacuum treatment is preferred to enhance oxygen removal from compact pores, the presinter treatment, like the sintering step, may be suitably carried out in the presence of a nonoxidizing atmosphere, such as a cracked ammonia atmosphere, a hydrogen atmosphere, or a dry inert gas atmosphere. In embodiments comprising a preferred copper addition, sintering is suitably carried out at a temperature above 1083° C., the melting point of copper, so as to produce the desired copper liquid phase. In general, higher temperatures are desired to accelerate diffusion bonding. However, practical problems are posed in handling compacts at temperatures above about 1150° C. Preferred sintering temperatures are between 1110° C. and 1120° C. It is desired that the time for sintering be sufficient for iron diffusion bonding and for diffusing the several elements into the iron lattice. For sintering temperatures within the preferred range, sintering times between about 15 and 35 minutes produce satisfactory structures.

While the compact may be suitably cycled within a single furnace chamber, it is preferred to process compacts in batches through a multi-chamber furnace comprising a first chamber for initial heating and lubricant vaporization, a second chamber for the presinter treatment in accordance with this invention, a third chamber for sintering and a fourth chamber for the final quench. A plurality of compacts is loaded in a basket and conveyed through the individual chambers. In such batch processing, the duration of the presintering treatment is selected to correspond to the desired sintering time.

While this invention has been described in terms of certain embodiments thereof, it is not intended that it be limited to the above description, but rather only to the extent set forth in the claims that follow.

The embodiments of the invention in which an exclusive property or privilege is claimed are defined as follows:

1. In a method for manufacturing an iron alloy article comprising compacting a predominantly iron powder mixture containing carbon powder, a liquating diffusible boron source and a vaporizable lubricant and heating the compact to vaporize the lubricant and thereafter to sinter the powder to form a product article, said sintering being carried out at a temperature effective to cause said boron source to form a liquid phase and to diffuse carbon and boron into the iron, the improvement comprising subjecting the compact to an oxygen-purge treatment following lubricant vaporization and prior to heating to sintering temperature, said oxygen-purge treatment being carried out at a temperature effective to decompose iron oxide within the compact without initiating said liquid phase and continuing at said temperature for a time sufficient to expel gas from the compact interior, whereupon oxygen contamination within said compact is reduced prior to activating said diffusible boron to thereby minimize boron oxidation and so enhance carbon and boron diffusion during sintering.

2. In a method for manufacturing an iron alloy article comprising dispersed borocementite particles, said method comprising compacting a predominantly iron powder mixture containing carbon powder, a liquating diffusible boron source and a vaporizable lubricant and heating the compact to a first temperature to vaporize the lubricant and thereafter to a relatively higher temperature to sinter the powder to form a product article, said sintering being carried out in a vacuum and at a temperature effective to cause said boron source to form a liquid phase and to diffuse carbon and boron into the iron to form the borocementite particles, the improvement comprising subjecting the compact to a presinter treatment following lubricant vaporization and prior to heating to sintering temperature, said treatment comprising vacuum heating the compact at a temperature effective to dissociate iron oxide present on iron surfaces within the compact, but not to initiate said boron-containing liquid phase, and continuing for a time sufficient to evacuate gas from the compact interior, whereupon oxygen contamination within the compact during sintering is reduced prior to activating said diffusible boron to thereby minimize boron oxidation and thus enhance carbon and boron diffusion during sintering.

3. In a method for manufacturing an iron alloy article comprising dispersed borocementite parties, said method comprising compacting a predominantly iron powder mixture containing carbon powder, a metal boron powder and a vaporizable lubricant and heating the compact to a temperature up to about 500° C. to vaporize the lubricant and thereafter to a temperature above about 1030° C. to cause said metal boride powder to form a liquid phase and to sinter the iron powder to form a product article, whereupon during sintering carbon and boron diffuse into the iron to form the borocementite particles, the improvement comprising subjecting the compact to a presinter treatment following lubricant vaporization and prior to heating to initiate said boride-derived liquid phase, said presinter treatment comprising heating the compact in a vacuum at a temperature between about 750° C. and 1030° C. for a period of at least five minutes to dissociate iron oxide within the compact and to evacuate oxygen gas released thereby to promote carbon and boron diffusion during sintering.

4. In a method for manufacturing an iron alloy article comprising dispersed borocementite parties, said method comprising compacting a predominantly iron powder mixture containing carbon powder, nickel boride powder, iron boride powder and a vaporizable lubricant and heating the compact up to about 500° C. to vaporize the lubricant and thereafter to above about 1100° C. to sinter the powder to form a product article, whereupon during sintering the nickel boride powder and iron boride powder form a liquid phase and carbon and boron diffuse into the iron to form the borocementite particles, the improvement comprising subjecting the compact to a presinter treatment following lubricant vaporization and prior to heating to sintering temperature, said treatment being carried out in a vacuum and comprising isothermally heating at a temperature between about 850° C. and 900° C. for between about 15 and 45 minutes, whereby iron oxide initially present on iron surfaces within the compact is dissociated and the resulting oxygen-bearing gas is purged prior to forming said liquid phase to increase borocementite formation during sintering.

* * * * *